United States Patent [19]

Conger, IV

[11] 4,119,686

[45] Oct. 10, 1978

[54] HYDRO-JET FITTING FOR HOT TUB

[75] Inventor: William W. Conger, IV, Los Osos, Calif.

[73] Assignee: California Cooperage, San Luis Obispo, Calif.

[21] Appl. No.: 838,878

[22] Filed: Oct. 3, 1977

[51] Int. Cl.[2] ..... A61H 33/02

[52] U.S. Cl. ..... 261/77; 4/180; 128/369; 261/124

[58] Field of Search ..... 261/77, 124; 4/180, 4/172.19, 178, 173 R; 285/190; D23/55; D24/38; 128/369

[56] References Cited

U.S. PATENT DOCUMENTS

| | | | |
|---|---|---|---|
| 1,201,395 | 10/1916 | Vissering | 261/124 |
| 2,540,948 | 2/1951 | Jeffery | 285/190 |
| 3,067,435 | 12/1962 | Nash | 261/77 |
| 3,147,015 | 9/1964 | Hanback | 285/190 |
| 3,348,330 | 10/1967 | Gilliam | 261/124 |
| 3,402,253 | 9/1968 | McGracken | 285/190 |
| 3,452,370 | 7/1969 | Jacuzzi | 4/180 |
| 3,627,355 | 12/1971 | Reddy | 285/190 |
| 3,905,358 | 9/1975 | Jacuzzi | 4/180 |
| 3,946,449 | 3/1976 | Mathis | 4/180 |
| 4,000,528 | 1/1977 | Posnick | 4/180 |

*Primary Examiner*—Frank W. Lutter
*Assistant Examiner*—Gregory N. Clements
*Attorney, Agent, or Firm*—Philip M. Hinderstein

[57] ABSTRACT

In a hydro-massage jet fitting for a hot tub wherein the fitting includes a venturi air-induction system which mixes air with water before pumping the water into the tub, there is disclosed an improvement wherein the passageway to conduct air to the fitting extends through the side wall of the tub to an annular space surrounding the body of the fitting and the fitting is modified to conduct the air from this space into the body.

4 Claims, 4 Drawing Figures

FIG. 2.
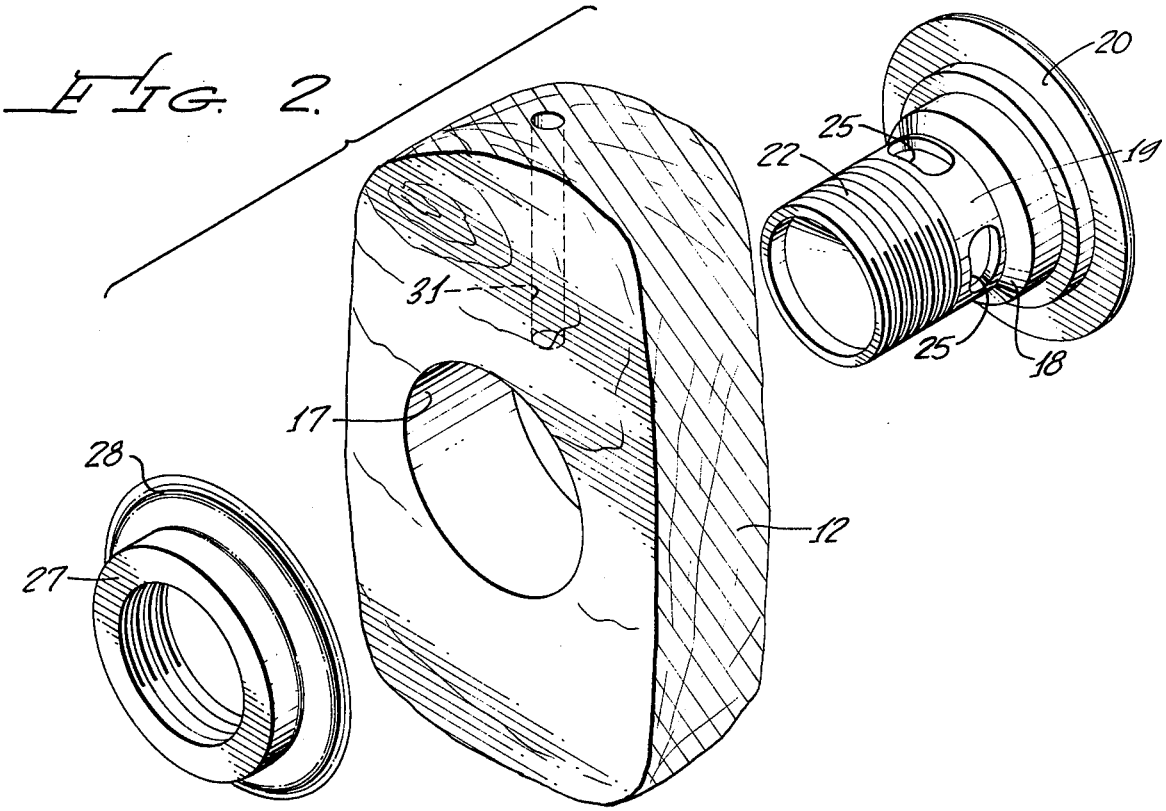
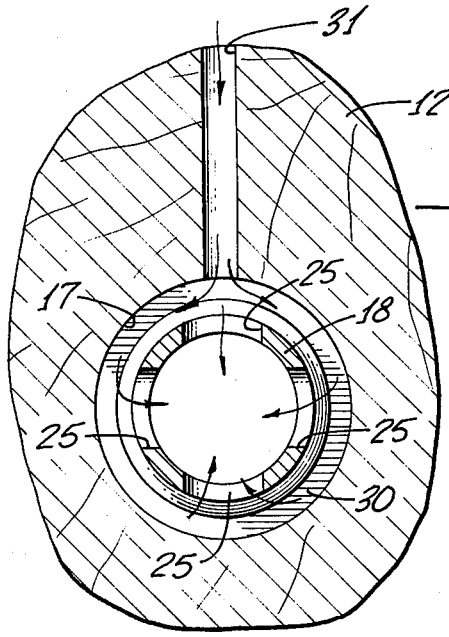
FIG. 4.

HYDRO-JET FITTING FOR HOT TUB

BACKGROUND OF THE INVENTION

1. Field of the Invention

The present invention relates to a hydro-jet fitting for a tub and, more particularly, to a method and means for conducting air to a hydro-jet fitting through the side wall of a tub.

2. Description of the Prior Art

While swimming pools and jacuzzies have been popular for many years, recent years have witnessed a significant upsurge in interest in hot tubs. In many cases, the hot tubs are molded in one piece from fiberglass and other materials. Alternatively, a hot tub is made from dried redwood in which the tub walls are formed of individual staves secured to a floor and held in position by steel hoops.

In either event, a complete tub contains a support system including most of the elements found in use with a swimming pool or a jacuzzi. The water must be heated and filtered and a pump included for circulating same. A variety of valves and fittings are utilized to control flow rate, rise time, and sensitivity.

Virtually all such tubs incorporate a closed-loop water circulation system including one or more hydro-massage jet fittings for mixing air with the water before pumping the water into the tub. By this means, the water in the tub is agitated, creating a hydro-massage action.

In a typical installation, one or more of such fittings are positioned in laterally-extending holes in the side wall of the tub, each fitting being connectable to a source of water for conducting water into the tub. The body of the fitting has an air inlet and a venturi air-induction system within the body draws air into the body from the air inlet and mixes the air with the water for conduction into the tub. The air inlet is commonly positioned external of the tub.

A problem is presented by the fact that the fitting is below the level of the water in the tub. As long as the pump is circulating water into the tub, air is drawn into the fitting. However, when the pump is turned off, water from the tub will be conducted into the fitting to the air inlet thereof. If the air inlet remains below the water level, the result would be that the tub would be drained through the air inlet.

For this reason, it has become necessary to connect one end of a hose, tube, or cane to the air inlet of the fitting and to position the other end of the cane above the water level. Therefore, when the pump is turned off, while the cane fills with water, such water does not immerge from the top end thereof.

While this arrangement prevents the draining of the tub, it is often an unacceptble solution to the problem. That is, in most tubs, multiple fittings are positioned therearound and each fitting requires its own air cane. The result is an unattractive assemblage of vertically oriented, spaced air canes positioned around the outside of the tub. In addition to this being unsightly, it is often difficult to install where the tub is mounted in a deck or other permanent structure. That is, it is usually either impractical, unfeasable, or unattractive to run these air canes through the deck. A suitable solution to this problem has been unavailable heretofore.

SUMMARY OF THE INVENTION

According to the present invention, these problems are solved by the provision of a hydro-jet fitting for a tub which eliminates the requirement for a separate air cane. In fact, with the present fitting, the only connection to the fitting is the pipe or other conduit which provides the source of water. By eliminating the air cane, the tub can be mounted in a deck or in any other location without unsightly air hoses extending through the deck. Accordingly, use of the present fitting preserves the natural, attractive appearance of a hot tub.

Briefly, in a hydro-jet fitting for a tub including a side wall, the fitting being positionable in a laterally-extending hole in the side wall and being connectable to a source of water for conducting water into the tub, the fitting including a body having a central portion extending through the hole in the side wall and flanges at opposite ends of the central portion, the flanges engaging the inner and outer surfaces of the side wall, the body of the fitting having an air inlet and the fitting including a venturi air-induction system for drawing air into the body from the air inlet and mixing the air with the water, the present invention is an improvement wherein the central portion of the body has an outside diameter which is less than the diameter of the side wall hole so as to define an enclosed annular space surrounding the body, the air inlet extending through the body and communicating with the annular space, and wherein the side wall of the tub has a continuous air passageway extending therethrough, from the top thereof to the annular space, for conducting air to the fitting.

It is therefore an object of the present invention to provide a hydro-jet fitting for a hot tub.

It is a further object of the present invention to provide a method and means for conducting air to a hydro-jet fitting through the side wall of a tub.

It is a still further object of the present invention to provide a hydro-jet fitting for a tub which eliminates external air canes.

It is another object of the present invention to provide a hydro-jet fitting for a hot tub in which the side wall of the tub provides a continuous passageway from the top thereof to the fitting.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 2 is an exploded perspective view of the fitting of the present invention;

FIG. 4 is a sectional view taken along the line 4—4 in FIG. 3.

DESCRIPTION OF THE PREFERRED EMBODIMENT

Figure 1:
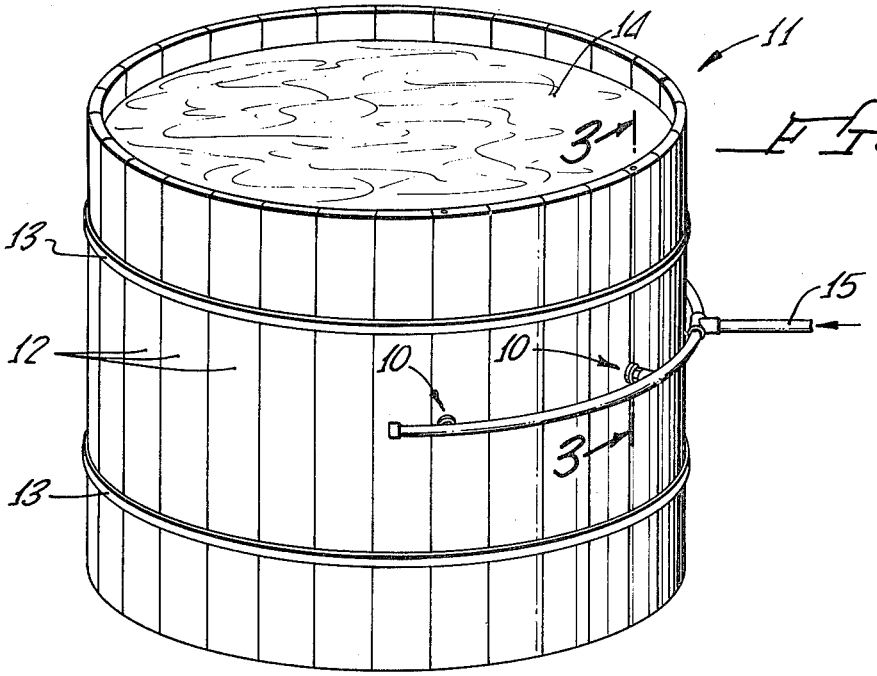
FIG. 1 is a perspective view of a hot tub having installed therein a hydro-massage water circulation system including fittings constructed in accordance with the teachings of the present invention.

Referring now to the drawings, the present invention relates to a hydro-jet fitting, generally designated 10, for a tub, generally designated 11. For purposes of explanation, tub 11 will be described as including a plurality of staves 12, preferably made from redwood, which are held together by one or more hoops 13 surrounding staves 12. Tub 11 is adapted to be filled with water 14 and used in a conventional manner. However, it will be evident to those skilled in the art that the teachings of the present invention are equally applicable to other types of tubs.

Tub 11 includes a support system (not shown) including a pump, a filter, a heater, and the like for circulating water 14 therethrough. Water 14 is conducted from the pump to tub 11 by means of a piping system 15 which may have multiple branches, as shown in FIG. 1, each branch terminating in a fitting 10.

Tub 11 includes a bottom (not shown) and a side wall formed from multiple interconnected staves 12. Selected staves 12 have laterally-extending holes 17 therein for receipt of a fitting 10. In its simplest configuration, each fitting 10 includes a body 18 having a hollow, cylindrical central portion 19 which extends through hole 17 in stave 12. One end of central portion 19 has an integral flange 20 which engages the inner surface of stave 12. This end of body 18 is internally threaded, at 21, for receipt of an optional "eye-ball" insert which permits selected ones of fittings 10 to be turned on and off from within tub 11. The other end of body 18 is externally threaded, at 22.

Preferably made integral with central portion 19 of body 18 is a venturi 23 through which water is conducted. Venturi 23 produces an area of low pressure at outlet 24 thereof. Such low pressure area can be utilized to draw air into body 18 for mixing with the water flowing therethrough. Accordingly, central portion 19 of body 18 has a plurality of holes 25 therein which, in combination, function as an air inlet surrounding outlet 24 of venturi 23. As known to those skilled in the art, venturi 23 causes air to be drawn into body 18 as water 14 flows therethrough, mixing such air with the water and conducting the mixture into tub 11.

Body 18 is secured in stave 21 through the use of an internally threaded nut 27 which engages threads 22, nut 27 including a flange 28 which engages the outer surface of stave 12. Accordingly, the tightening of nut 27 on body 18 secures fitting 10 within hole 17 in stave 12.

Figure 3:
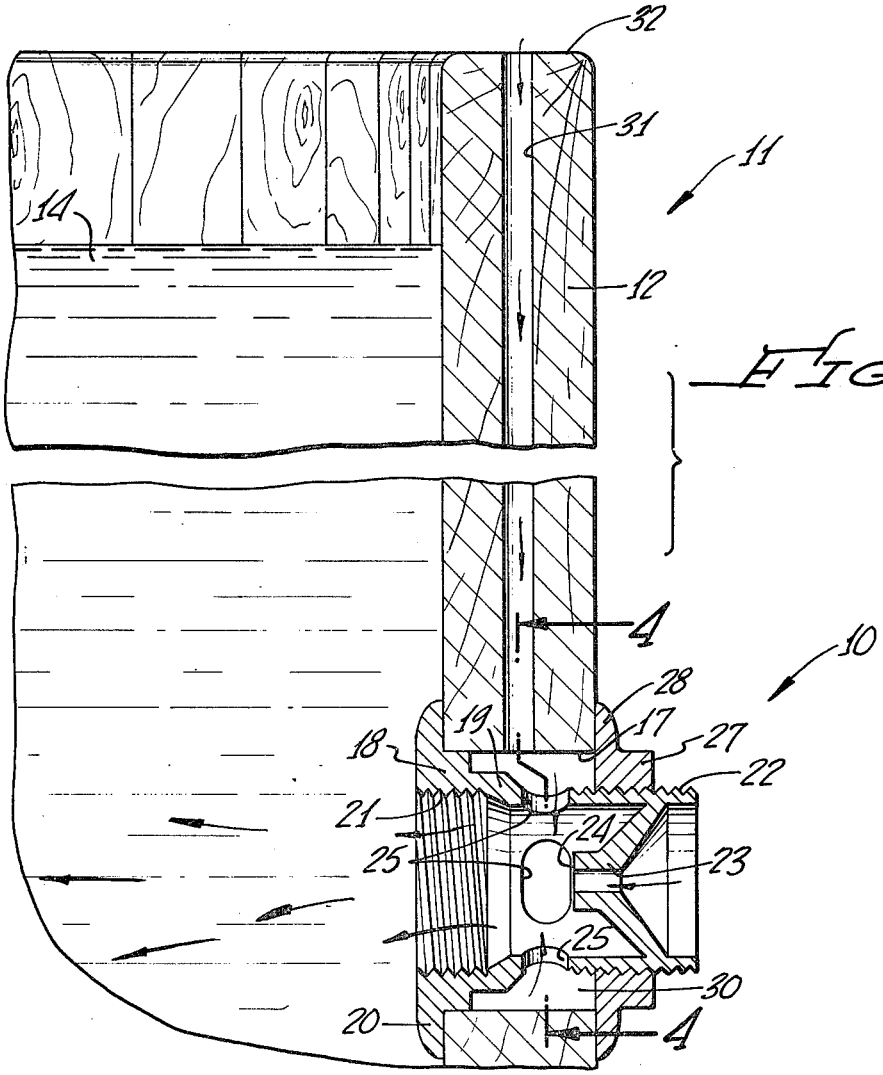
FIG. 3 is a sectional view taken along the line 3—3 in FIG. 1.

According to the present invention, central portion 19 of body 18 has an outside diameter which is less than the diameter of hole 17 in stave 12 so as to define an enclosed annular space 30 surrounding body 18. As is seen in FIG. 3, space 30 is in communication with holes 25 in body 18. Space 30 is bounded by central portion 19 of body 18, by hole 17 in stave 12, and by flanges 20 and 28.

According to the present invention, each stave 12 which has a fitting 10 therein has a continuous air passageway 31 extending therethrough, preferably from the top surface 33 of stave 12 to space 30. In this manner, air passageway 31 connects space 30 with the atmosphere so that space 30 is provided with a continuous source of air. Furthermore, it is evident that the open end of air passageway 31 is above the level of water 14 in tub 11. Therefore, when water is not circulating through fitting 10, body 18 and space 30 fill with water, but passageway 31 will fill with water only to the level of water 14 inside of tub 11. In this manner, water will be prevented from escaping from tub 11.

The operation of fitting 10 is the same as in known hydro-jet fittings. As water is pumped via piping system 15 into each of fittings 10, air is drawn downwardly through air passageway 31, through space 30 and holes 25 into body 18 of fitting 10. Once therein, the air is mixed with the water and circulated into tub 11.

It can therefore be seen that according to the present invention, the problems encountered heretofore are solved by the provision of a novel hydro-jet fitting for a tub. The present fitting eliminates the requirement for a hose, tube, or cane. In fact, with fitting 10, the only connection thereto is the pipe or other conduit which provides the source of water. By eliminating the air cane, tub 11 can be mounted in a deck or in any other location without unsightly air hoses extending through the deck. Accordingly, use of fitting 10 preserves the natural, attractive appearance of a hot tub such as tub 11.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In the combination of a hydro-jet fitting and a tub, the tub including a side wall consisting of a plurality of thin, uniform staves, one of said staves having a laterally-extending hole therein, said fitting being positioned in said hole in said one stave and being connectable to a source of water for conducting water into said tub, said fitting including a body having a central portion extending through said hole in said one stave, said body having an air inlet and said fitting including a venturi for drawing air into said body from said air inlet and mixing said air with said water, the improvement wherein:

at least some of said central portion of said body is spaced from the surface of said hole in said one stave so as to define an enclosed chamber between said body and said hole surface, said air inlet communicating with said chamber; and wherein:

said one stave of said side wall of said tub has a continuous air passageway extending therethrough, from adjacent the top thereof to said chamber, for conducting air to said fitting.

2. In the combination of a hydro-jet fitting and a tub, the tub including a side wall consisting of a plurality of thin, uniform staves held in position by one or more hoops surrounding same, one of said staves having a laterally-extending hole therein, said fitting being positioned in said hole in said one stave and being connectable to a source of water for conducting water into said tub, said fitting including a body having a central portion extending through said hole in said one stave and flanges at opposite ends of said central portion, said flanges engaging the inner and outer surfaces of said one stave, said body of said fitting having an air inlet in said central portion thereof and said fitting including a system for drawing air into said body from said air inlet and mixing said air with said water, the improvement wherein:

said central portion of said body has an outside diameter which is less than the diameter of said hole in said one stave so as to define an enclosed annular space surrounding said body, said air inlet extending through said body and communicating with said annular space; and wherein said one stave of said side wall of said tub has a continuous air passageway extending therethrough, from a location above the level of the water in said tub to said annular space, for conducting air to said fitting.

3. In the combination according to claim 2, the improvement wherein said annular space is bounded by said central portion of said body, said hole in said one stave, and said flanges of said fitting.

4. In the combination according to claim 1, the improvement wherein said central portion of said body has a plurality of holes therein, spaced therearound, said holes communicating with said annular space and forming said air inlet of said fitting.

* * * * *